US008231412B2

(12) United States Patent
Paglia et al.

(10) Patent No.: US 8,231,412 B2
(45) Date of Patent: Jul. 31, 2012

(54) ELECTRICAL CONNECTOR WITH GROUNDING MEMBER

(75) Inventors: Richard Paglia, Springfield, MA (US); Bryan Blunt, Casa Grande, AZ (US); Weixing Chen, Changzhou (CN); Minghua Gu, Changzhou (CN); Caichun Song, Changzhou (CN)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 13/368,047

(22) Filed: Feb. 7, 2012

(65) Prior Publication Data

US 2012/0142217 A1 Jun. 7, 2012

Related U.S. Application Data

(63) Continuation of application No. 13/286,570, filed on Nov. 1, 2011, now abandoned.

(60) Provisional application No. 61/408,927, filed on Nov. 1, 2010.

(51) Int. Cl.
*H01R 13/648* (2006.01)

(52) U.S. Cl. ..... 439/607.17; 439/583

(58) Field of Classification Search ..... 439/607.41, 439/607.17, 607.18, 583–585, 578
See application file for complete search history.

(56) References Cited

U.S. PATENT DOCUMENTS

| | | | | |
|---|---|---|---|---|
| 7,114,990 | B2 | 10/2006 | Bence et al. | |
| 7,306,484 | B1 | 12/2007 | Mahoney et al. | |
| 7,479,035 | B2 | 1/2009 | Bence et al. | |
| 7,566,236 | B2 | 7/2009 | Malloy et al. | |
| 7,674,132 | B1 * | 3/2010 | Chen | 439/578 |
| 7,753,705 | B2 | 7/2010 | Montena | |
| 7,828,595 | B2 | 11/2010 | Mathews | |
| 7,833,053 | B2 | 11/2010 | Mathews | |
| 7,845,976 | B2 | 12/2010 | Mathews | |
| 7,950,958 | B2 | 5/2011 | Mathews | |
| 7,955,126 | B2 | 6/2011 | Bence et al. | |
| 2006/0110977 | A1 | 5/2006 | Matthews | |
| 2006/0166552 | A1 * | 7/2006 | Bence et al. | 439/578 |
| 2008/0102696 | A1 | 5/2008 | Montena | |
| 2009/0098770 | A1 | 4/2009 | Bence et al. | |
| 2010/0279548 | A1 | 11/2010 | Montena et al. | |
| 2010/0297875 | A1 * | 11/2010 | Purdy et al. | 439/578 |
| 2011/0053413 | A1 | 3/2011 | Mathews | |
| 2011/0143567 | A1 | 6/2011 | Purdy et al. | |
| 2011/0230089 | A1 | 9/2011 | Amidon et al. | |

* cited by examiner

*Primary Examiner* — Tulsidas C Patel
*Assistant Examiner* — Travis Chambers
(74) *Attorney, Agent, or Firm* — Blank Rome LLP

(57) ABSTRACT

An electrical connector that comprises a connector body that has opposite first and second ends. The first end is configured to be coupled with a prepared end of a cable. A coupling member that has an interface end configured to interface with a mating connector and an free end opposite the interface end that is rotatable with respect to the connector body at the second end of the connector body. A resilient grounding member is disposed between an outer surface of the second end of the connector body and the free end of the coupling member. Each of the connector body, the coupling member, and the resilient grounding member is conductive thereby creating a grounding path between the connector body and the coupling member.

9 Claims, 3 Drawing Sheets

ELECTRICAL CONNECTOR WITH GROUNDING MEMBER

RELATED APPLICATION

This application is a continuation of copending commonly owned application Ser. No. 13/286,570, filed on Nov. 1, 2011, entitled Electrical Connector with Grounding Member.

FIELD OF THE INVENTION

The present invention relates to a grounding member for an electrical connector, such as a coaxial cable connector.

BACKGROUND OF THE INVENTION

Coaxial cable connectors are typically used to connect a coaxial cable with a mating port or terminal of another device, such as equipment, appliances, and the like. For various reasons, such as movement of the equipment, vibrations, or improper installation of the connector, the connection between the coaxial connector and the mating port often becomes loose. That may result in a poor signal quality and RFI leakage due to the weak connection between the conductors of the mating port and coaxial cable. Therefore, a need exists for an alternative grounding path between those conductors that can compensate for a loose connection between the coaxial connector and its mating port.

Examples of prior art coaxial connectors with a grounding mechanism include U.S. Pat. No. 7,753,705 to Montena and U.S. Pat. No. 7,114,990 to Bence et al., the subject matter of each of which is hereby incorporated by reference.

SUMMARY OF THE INVENTION

Accordingly, the present invention provides an electrical connector that comprises a connector body that has opposite first and second ends. The first end is configured to be coupled with a prepared end of a cable. A coupling member has an interface end configured to interface with a mating connector and a free end opposite the interface end that is rotatable with respect to the connector body at the second end thereof. A resilient grounding member is disposed between an outer surface of the second end of the connector body and the free end of the coupling member. Each of the connector body, the coupling member, and the resilient grounding member is conductive, thereby creating a grounding path between the connector body and the coupling member.

The present invention also provides an electrical connector that comprises a connector body that has opposite first and second ends. The first end is configured to be coupled with a prepared end of a cable. A coupling member has an interface end configured to interface with a mating connector and an free end opposite the interface end that is rotatable with respect to the connector body at the second end of the connector body. A resilient grounding member is disposed between an outer surface of the second end of the connector body and an outer surface the free end of the coupling member, such that no portion of the grounding member is located inside of either of the connector body or the coupling member. Each of the connector body, the coupling member, and the resilient grounding member is conductive thereby creating a grounding path between the connector body and the coupling member.

An electrical connector that comprises a connector body that has opposite first and second ends. The first end is configured to be coupled with a prepared end of a cable. A coupling member that has an interface end configured to interface with a mating connector and an free end opposite the interface end that is rotatable with respect to the connector body at the second end of the connector body. Means for grounding located between the second end of the connector body and the free end of the coupling member. The means for grounding providing a grounding path between the connector body and the coupling member.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Referring to FIGS. 1, 2, 3A, 3B, 4, and 5, the present invention relates to an electrical connector 100, such as a coaxial connector, that includes a grounding member 110 which insures a continuous grounding path between a cable coupled to the connector 100 and a corresponding mating connector or port (not shown) of a device, such as a television, even if the connection therebetween becomes loose.

Figures 3A, 3B:
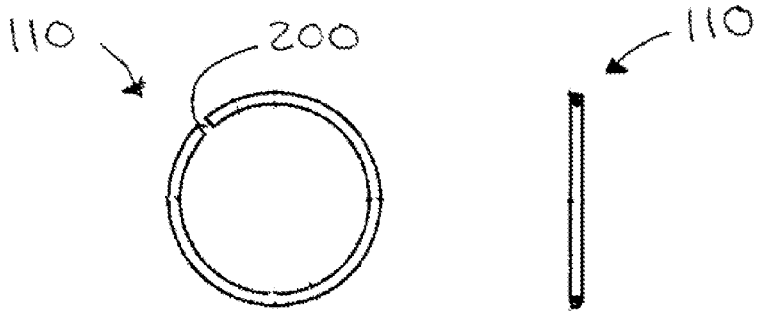
FIGS. 3A and 3B are cross-sectional and elevational views, respectively, of a grounding member of the electrical connector illustrated in FIG. 1.

The connector 100 generally includes the grounding member 110, a connector body 120, a coupling member 130, and a post member 140. A compression ring 170 may be provided to facilitate termination of the cable with the connector. The grounding member 110, seen in FIGS. 3A and 3B, is disposed on the outside of the connector 100, such that no portion of the grounding member 110 is located inside of either of the connector body 120 or the coupling member 130 in order for it to maintain electrical contact between the coupling member 130 and the connector body 120. Due to the grounding member 110, such electrical contact will be maintained even if the connection between the connector 100 and its mating connector or port becomes loose.

The post member 140 has a substantially tubular shape with an enlarged shoulder 142 at one end 146 adapted to couple with the coupling member 130, and an opposite end 144 designed to interface with a prepared end of a coaxial cable (not shown), as is well known in the art. The post member 140 is received in both the connector body 120 and the coupling member 130, as seen in FIG. 1, such that the coupling member 130 rotates with respect to the post member 140 at the end 146, and the connector body 120 engages the post member 140 in a tight or friction fit.

Figure 1:
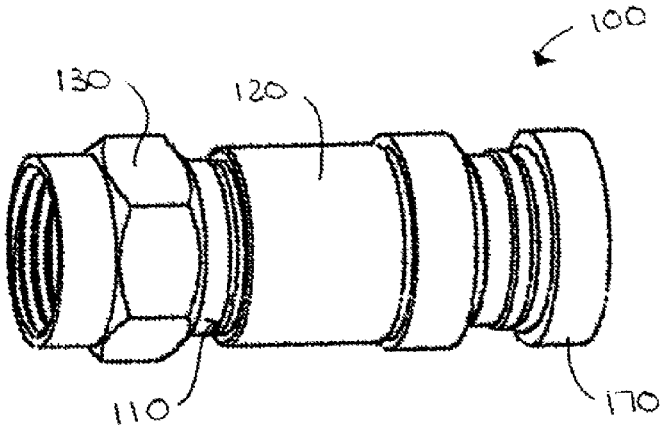
FIG. 1 is a perspective view of an electrical connector in accordance with an exemplary embodiment of the present invention.
Figure 2:
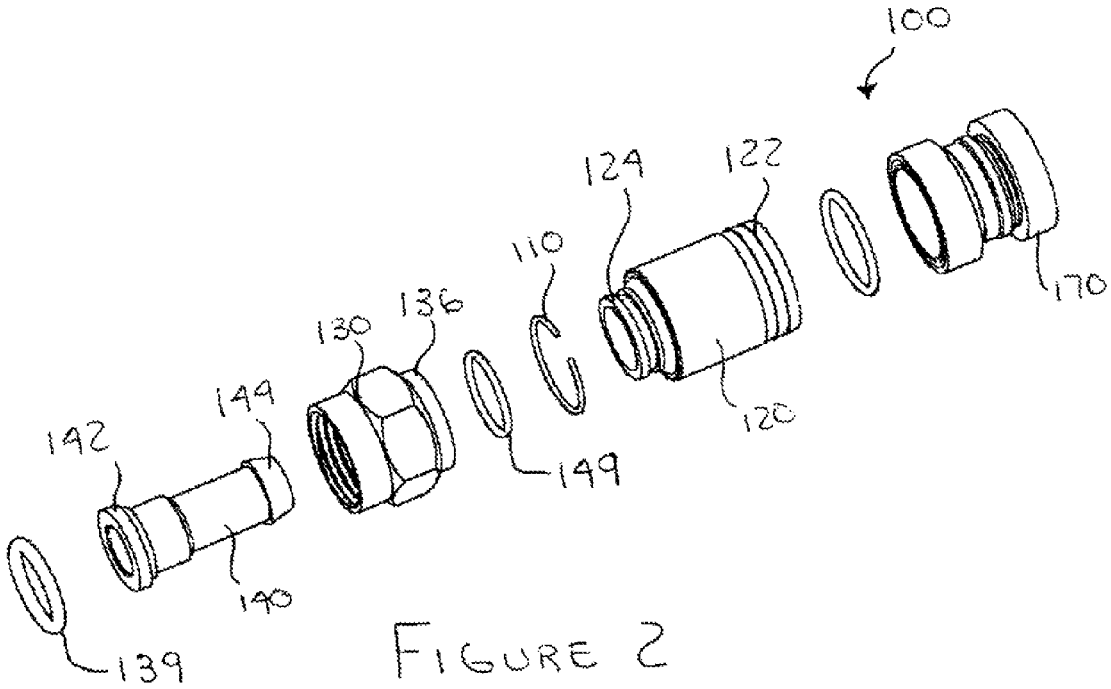
FIG. 2 is an exploded perspective view of the electrical connector illustrated in FIG. 1.
Figure 5:
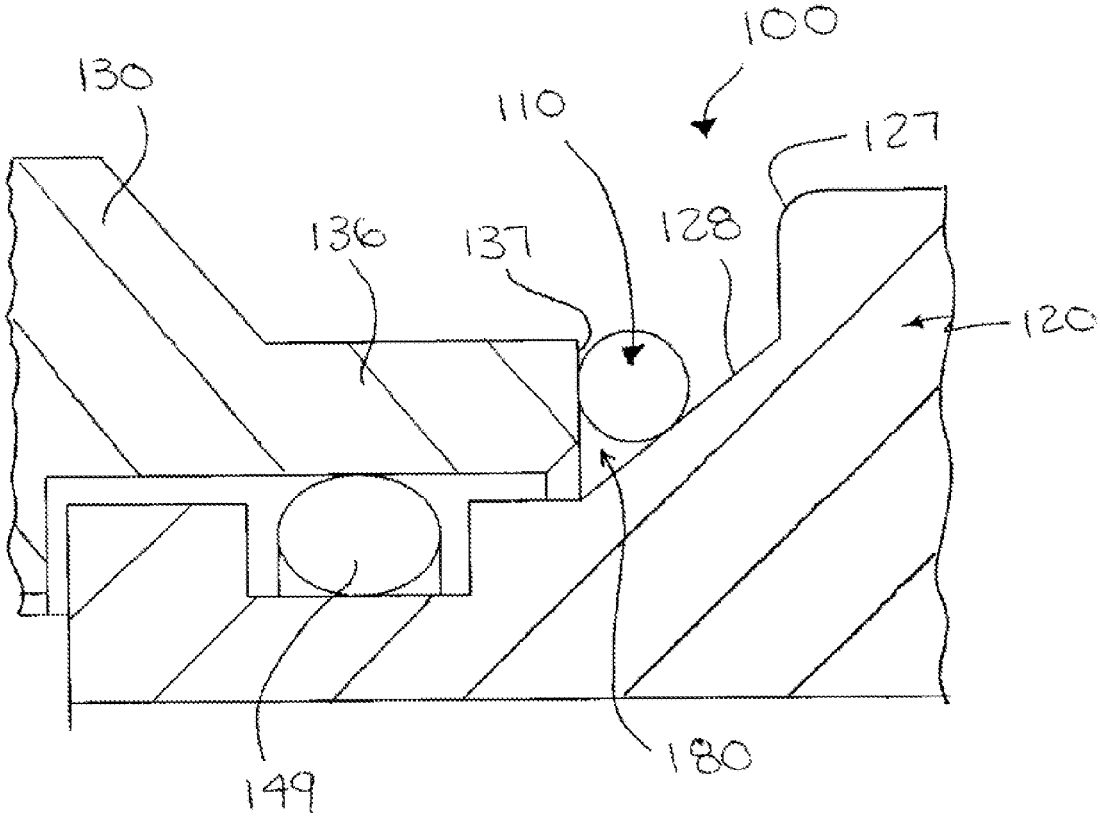
FIG. 5 is an enlarged cross-sectional view similar to FIG. 4, showing the location of the grounding member.

The coupling member 130 is preferably a nut with internal threads 132, as best seen in FIGS. 1 and 2, and is adapted to engage external threads of a mating connector or port. The coupling member 130 includes an interface end 134 which engages the mating connector and an opposite free end 136 with an end face surface 137 (FIG. 5). Near the free end 136 of the coupling member 130 is an internally extending shoulder 138 that catches the enlarged shoulder 142 of the post member 140, thereby rotatably coupling the coupling member 130 to the post member 140. An O-ring 139 is preferably provided inside of the coupling member 130 to prevent moisture migration.

As seen in FIGS. 1 and 2, the connector body 120 is generally tubular in shape with a first end 122 adapted to couple with the prepared end of the cable, as is well known in the art, and a opposite tapered second end 124 that engages the post member 140. At its second end 124, the connector body 120 may include a transition portion 126 that may have a transition shoulder 127 and a tapered surface 128. Alternatively, the transition portion 126 may just have a tapered surface or may be a series of tapered shoulders. The transition portion 126 meets the free end 136 of the coupling member 130, as seen in FIG. 1. A gap 180, as seen in FIG. 5, exists between the transition portion of the connector body 120 and the end face surface 137 of the coupling member 130. That gap 180 may vary due to tolerances in the connector. An O-ring 149 may be provides between the overlap of the free end 136 of the coupling member 130 and the second end 124 of the connector body 120 to prevent moisture migration.

Figure 4:
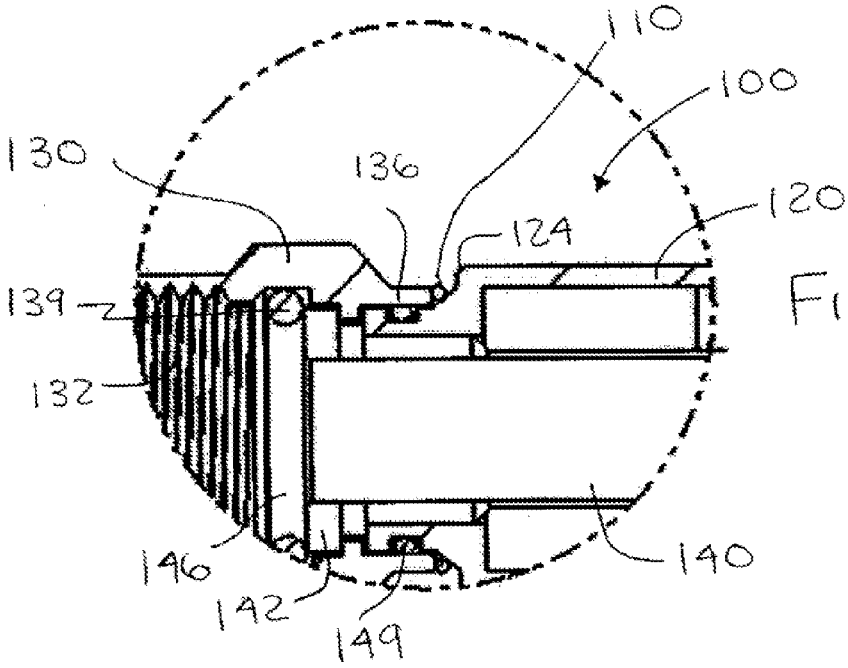
FIG. 4. is a partial cross-sectional view of the electrical connector illustrated in FIG. 1.

As seen FIGS. 2, 3A and 3B, the grounding member 110 is preferably a ring that is resilient to form a tight fit over the connector body 120 and the coupling nut 130. For example, the grounding member 110 may be a spring coil, wave washer, star washer and the like. Alternatively, the grounding member 110 may be a conductive O-ring. The grounding member 110 may include a cutout portion 200 (FIG. 3A) to facilitate assembly of the grounding member 110 on the connector 100. As seen in FIGS. 4 and 5, the grounding member 110 preferably sits in the gap 180 between the free end 136 of the coupling member 130 and the second end 124 of the connector body 120. In particular, the grounding member 110 may be in contact with adjacent surfaces of the components, that is in contact with the transition portion 126 of the connector body's second end 124 and the end surface of the coupling member's free end 136. Because the grounding member 110 is resilient, it will remain in place and provide a consistent grounding path between the connector body 120 and the coupling member 130. Although, it is preferably that the grounding member 110 be located in the gap 180, the grounding member 110 may be located any outer or exposed surface of the connector body 120 and the coupling member 130 as long as the grounding member is in contact with adjacent surfaces of both components to maintain electrical continuity therebetween.

While a particular embodiment has been chosen to illustrate the invention, it will be understood by those skilled in the art that various changes and modifications can be made therein without departing from the scope of the invention as defined in the appended claims.

What is claimed is:

1. An electrical connector, comprising:

a connector body having opposite first and second ends, said first end being configured to be coupled with a prepared end of a cable;

a coupling member having an interface end configured to interface with a mating connector and a free end opposite said interface end that is rotatable with respect to said connector body at said second end of said connector body; and a resilient grounding member disposed between an outer surface of said second end of said connector body and an outer surface of said free end of said coupling member, such that no portion of said grounding member is located inside of either of said connector body or said coupling member, whereby each of said connector body, said coupling member, and said resilient grounding member is conductive thereby creating a grounding path between said connector body and said coupling member.

2. An electrical connector according to claim 1, wherein said grounding member extends substantially around said outer surface of said second end of said connector body.

3. An electrical connector according to claim 1, wherein said grounding member is one of a spring coil, wave spring, and O-ring.

4. An electrical connector according to claim 1, wherein said grounding member includes a cutout portion.

5. An electrical connector, comprising:

a connector body having opposite first and second ends, said first end being configured to be coupled with a prepared end of a cable;

a coupling member having an interface end configured to interface with a mating connector and a free end opposite said interface end that is rotatable with respect to said connector body at said second end of said connector body; and means for grounding located outside of said connector body and outside of said coupling member, said means for grounding providing a grounding path between said connector body and said coupling member.

6. An electrical connector according to claim 5, wherein said means for grounding being disposed between adjacent outer surfaces of said connector body and said coupling member.

7. An electrical connector according to claim 5, wherein said means for grounding is resilient.

8. An electrical connector according to claim 5, wherein said means for grounding includes a ring extending substantially around said second end of said connector body.

9. An electrical connector according to claim 8, wherein said ring includes a cutout portion.

* * * * *